US008331571B2

(12) United States Patent
Taufour et al.

(10) Patent No.: US 8,331,571 B2
(45) Date of Patent: Dec. 11, 2012

(54) METHOD AND DEVICE FOR CONTROLLING THE BROADCASTING OF AUDIO CONTENTS BY TWO LOUDSPEAKERS

(75) Inventors: Vianney Taufour, Le Pont de Claix (FR); Gael Lassure, Saint Martin (FR)

(73) Assignee: STMicroelectronics (Grenoble 2) SAS, Grenoble (FR)

( * ) Notice: Subject to any disclaimer, the term of this patent is extended or adjusted under 35 U.S.C. 154(b) by 303 days.

(21) Appl. No.: 12/767,476

(22) Filed: Apr. 26, 2010

(65) Prior Publication Data

US 2010/0272292 A1 Oct. 28, 2010

(30) Foreign Application Priority Data

Apr. 28, 2009 (FR) ..... 09 52782

(51) Int. Cl.
*H04H 20/88* (2008.01)

(52) U.S. Cl. ..... 381/2; 381/30; 381/332

(58) Field of Classification Search ..... 381/2, 30, 381/35, 59, 89, 119, 332
See application file for complete search history.

(56) References Cited

U.S. PATENT DOCUMENTS

2006/0204022 A1* 9/2006 Hooley et al. ..... 381/117

FOREIGN PATENT DOCUMENTS

| | | | |
|---|---|---|---|
| EP | 1699259 | A1 | 9/2006 |
| EP | 1921890 | A2 | 5/2008 |
| JP | 2008011253 | A | 1/2008 |

OTHER PUBLICATIONS

Preliminary Search Report, FR 0952782, Mar. 10, 2010, 2 pages.

* cited by examiner

*Primary Examiner* — Fan Tsang
*Assistant Examiner* — Eugene Zhao
(74) *Attorney, Agent, or Firm* — Gardere Wynne Sewell LLP

(57) ABSTRACT

The broadcasting of audio contents by two loudspeakers is controlled by delivering a first audio content to the two loudspeakers and a further processing in which an auxiliary audio content is received. A second audio content is formed by temporally delaying the auxiliary audio content with a delay dependent on the spacing between the loudspeakers and on a distance between a first loudspeaker and a spot located in front of this first loudspeaker. The second audio content is delivered to the first loudspeaker. A third audio content is formed by inverting the auxiliary audio content. The third audio content is then delivered to the second loudspeaker.

31 Claims, 7 Drawing Sheets

METHOD AND DEVICE FOR CONTROLLING THE BROADCASTING OF AUDIO CONTENTS BY TWO LOUDSPEAKERS

PRIORITY CLAIM

This application claims priority from French Application for Patent No. 09-52782 filed Apr. 28, 2009, the disclosure of which is hereby incorporated by reference.

TECHNICAL FIELD

The invention relates to the broadcasting of audio contents by loudspeakers having in particular a large directivity angle.

BACKGROUND

Broadcasters of television programs, transmitted directly or by way of decoder boxes ("Set Top Box", to use the term well known to the person skilled in the art), sometimes transmit a dual audio content (two different audio programs) associated with a single video channel, so as to provide additional services to their customers (for example, a program associated with an audiodescription of this program for partially-sighted people).

The transmission of multiple audio contents is becoming increasingly common, and their decoding is supported by most television sets and current decoders.

A problem appears when it is desired to listen to the two audio contents at the same time, using the loudspeakers of a television for example.

Indeed, as the right and left loudspeakers generally have wide directivity, it is not possible to deliver the sound of the two audio programs simultaneously (for example, by using the left loudspeaker for a first or the left program and the right loudspeaker for a second or the right program). Indeed, the sound will be mixed acoustically and the people watching the television will hear the two audio programs simultaneously.

This problem also appears with game consoles when two players are playing on the same screen. Indeed, although the two players can share the same atmospheric music, it is not desirable for the sounds generated by that part of the game intended for one player to be able to be heard by the other player.

A conventional solution consists in broadcasting a first audio content on the loudspeakers while the a second audio content is broadcast on a headset pick-up.

However, with such a solution, a person wishing to listen to an auxiliary audio program must purchase an additional piece of equipment (for example a headset) so as to be capable of listening to his audio program without bothering the other listener. Moreover, the number of people watching the program is limited by the number of headsets that can be connected to the television.

SUMMARY

According to one mode of implementation and embodiment, there is proposed a method and a device making it possible to control the directivity of the loudspeakers so as to create two independent zones allowing for example a partially-sighted person to hear an audiodescription of a TV program without the broadcasting of this audiodescription being able to bother another viewer, not partially sighted, who is simultaneously watching the same TV program.

It is also possible, for example, for two viewers to listen to and to see two TV programs at the same time on one and the same television without additional equipment while not bothering one another at the sound level.

According to one aspect, there is thus proposed a method of controlling the broadcasting of audio contents by two loudspeakers; this method applies most particularly to loudspeakers having wide directivity, that is to say respectively exhibiting broadcasting zones having a common part that can extend in front of the two loudspeakers. The method comprises: a delivery of a first audio content, for example a television program, to the two loudspeakers, a reception of an auxiliary audio content, for example an audiodescription of this television program, a formulation of a second audio content comprising a temporal delaying of the auxiliary audio content with a delay dependent on the spacing between the two loudspeakers and on a distance between a first loudspeaker, for example the left loudspeaker, and a spot located in front of this first loudspeaker, a delivery of the second audio content to this first loudspeaker, a formulation of a third audio content comprising an inversion of the auxiliary content, and a delivery of the third audio content to the second loudspeaker, for example the right loudspeaker.

Thus, a partially-sighted person located in front of the right loudspeaker will hear the normal television program and the audiodescription of this program, while another viewer, who is not partially-sighted, located in front of the left loudspeaker, will perceive only the television program without perceiving the audiodescription of this program.

Preferably, the formulation of the third audio content comprises, in addition to the inversion of the auxiliary content, an amplification of the inverted auxiliary content with a gain whose value depends on the distance, and a processing for compensating for the non-linearity of the frequency response of the second loudspeaker, along an axis linking the second loudspeaker to the spot.

So as to improve the audio content of each channel, there is advantageously provided a preprocessing of the auxiliary audio content before the formulation of the second and third audio contents.

When the auxiliary audio content is a monophonic content, this preprocessing comprises at least one first and one second elementary processing of the monophonic auxiliary content, each elementary processing containing a bandpass filtering followed by a dynamic range compression processing and a summation of the signals respectively arising from the elementary processing. This makes it possible to obtain a clear voice with existing adjoining signals that are, however, hardly disruptive.

When the auxiliary audio content is a stereophonic content, the preprocessing comprises prior to the elementary processing which have just been mentioned, a transformation of the stereophonic auxiliary audio content into a monophonic auxiliary audio content.

So as to homogenize the whole of the signal and thus reduce the characteristics of the sound environment, provision is advantageously made for the preprocessing to comprise furthermore a third elementary processing comprising a low-pass filtering followed by a dynamic range compression processing.

So as to correct the brightness and the clarity of the sound, there is advantageously provided a fourth elementary processing comprising a high-pass filtering followed by a dynamic range compression processing.

There is also proposed, according to another mode of implementation, a method of controlling the broadcasting of audio contents by two loudspeakers, which is for example more particularly intended for the simultaneous broadcasting of two television programs by the loudspeakers of one and the same television.

According to this other mode of implementation, this method comprises: a reception of a first audio content, for example the first television program, a formulation of a second audio content comprising a temporal delaying of the first audio content with a delay dependent on the spacing between the two loudspeakers and on a first distance between a first loudspeaker, for example the left loudspeaker, and a first spot located in front of this first loudspeaker, a delivery of the second audio content to this first loudspeaker, a formulation of a third audio content comprising an inversion of the first audio content, and a delivery of the third audio content to the second loudspeaker, for example to the right loudspeaker, a reception of a fourth audio content, for example the second television program, a formulation of a fifth audio content comprising a temporal delaying of the fourth audio content with a delay dependent on the spacing between the loudspeakers, and on a second distance between the second loudspeaker (the right loudspeaker, for example), and a second spot located in front of this second loudspeaker, a delivery of the fifth audio content to this second loudspeaker, a formulation of a sixth audio content comprising an inversion of the fourth audio content, and a delivery of the sixth audio content to the first loudspeaker, for example the left loudspeaker.

Thus, the viewer situated in front of the left loudspeaker watches on the left part of the television the first television program, and perceives the audio content relating to this first television program, without perceiving the audio content relating to the second television program.

Likewise, the viewer located in front of the right loudspeaker watches the second television program on the right part of the television, and perceives the audio content relating to this second television program without being bothered by the audio content relating to the first television program.

According to one mode of implementation, the formulation of the third audio content furthermore comprises an amplification of the first inverted audio content with a gain whose value depends on the first distance, and a processing for compensating for the non-linearity of the frequency response of the second loudspeaker along an axis linking the second loudspeaker to the first spot; and the formulation of the sixth audio content furthermore comprises an amplification of the fourth inverted audio content with a gain whose value depends on the second distance, and a processing for compensating for the non-linearity of the frequency response of the first loudspeaker along an axis linking the first loudspeaker to the second spot.

According to one mode of implementation, the first and fourth audio contents are stereophonic contents and the method furthermore comprises: a first preprocessing of the first audio content before the formulation of the second and third audio contents, and a second preprocessing of the fourth audio content before the formulation of the fifth and sixth audio contents, each preprocessing comprising a transformation of the corresponding stereophonic audio content into a monophonic audio content, at least one first and one second elementary processing of the monophonic audio content, each elementary processing containing bandpass filtering followed by a dynamic range compression processing, and a summation of the signals respectively arising from the elementary processing.

Each preprocessing can advantageously comprise a third elementary processing comprising a low-pass filtering followed by a dynamic range compression processing and/or a fourth elementary processing comprising a high-pass filtering followed by a dynamic range compression processing.

In other applications, for example in video games applications, there may be provision for the delivery of an additional audio content to the two loudspeakers, this additional audio content possibly being an atmospheric sound audio content.

According to another aspect, there is proposed a device for controlling the broadcasting of audio contents by two loudspeakers, comprising: first delivery means configured to deliver a first audio content to the two loudspeakers, reception means configured to receive an auxiliary audio content, first formulation means configured to formulate a second audio content comprising delay means configured to temporally delay the auxiliary audio content with a delay dependent on the spacing between the loudspeakers and on a distance between a first loudspeaker and a spot located in front of this first loudspeaker, second delivery means configured to deliver the second audio content to this first loudspeaker, second formulation means configured to formulate a third audio content comprising inversion means configured to perform an inversion of the auxiliary audio content, and third delivery means configured to deliver the third audio content to the second loudspeaker.

According to one embodiment, the second formulation means furthermore comprise amplification means configured to amplify the inverted auxiliary audio content with a gain whose value depends on the distance, and a processing block configured to perform a processing for compensating for the non-linearity of the frequency response of the second loudspeaker along an axis linking the second loudspeaker to the spot.

According to one embodiment, the auxiliary audio content is a monophonic content and the device furthermore comprises a preprocessing module coupled between the reception means and the first and second formulation means, this preprocessing module comprising at least one first and one second branch for processing the monophonic auxiliary audio content, each processing branch containing bandpass filtering means followed by a dynamic range compression processing block, and summation means coupled to the outputs of the processing branches.

According to one embodiment, in which the auxiliary audio content is a stereophonic content, the device furthermore comprises a preprocessing module coupled between the reception means and the first and second formulation means, this preprocessing module comprising a stage for transforming the stereophonic auxiliary audio content into a monophonic auxiliary audio content, at least one first and one second branch for processing the monophonic auxiliary audio content, each processing branch containing bandpass filtering means followed by a dynamic range compression processing block, and summation means coupled to the outputs of the processing branches.

According to one embodiment, the preprocessing module furthermore comprises a third processing branch comprising low-pass filtering means followed by a dynamic range compression processing block.

According to one embodiment, the preprocessing module furthermore comprises a fourth processing branch comprising high-pass filtering means followed by a dynamic range compression processing block.

According to another embodiment, there is proposed a device for controlling the broadcasting of audio contents by two loudspeakers, comprising: first reception means configured to receive a first audio content, first formulation means configured to formulate a second audio content comprising first delay means configured to temporally delay the first audio content with a delay dependent on the spacing between the loudspeakers and on a first distance between a first loudspeaker and a first spot located in front of this first loudspeaker, first delivery means configured to deliver the second audio content to this first loudspeaker, second formulation means configured to formulate a third audio content comprising first inversion means configured to perform an inversion of the first audio content, second delivery means configured to deliver the third audio content to the second loudspeaker, second reception means configured to receive a fourth audio content, third formulation means configured to formulate a fifth audio content comprising second delay means configured to temporally delay the fourth audio content with a delay dependent on the spacing between the loudspeakers and on a second distance between the second loudspeaker and a second spot located in front of this second loudspeaker, third delivery means configured to deliver the fifth audio content to this second loudspeaker, fourth formulation means configured to formulate a sixth audio content comprising second inversion means configured to perform an inversion of the fourth audio content, and fourth delivery means configured to deliver the sixth audio content to the first loudspeaker.

According to one embodiment, the second formulation means furthermore comprise first amplification means configured to amplify the first inverted audio content with a gain whose value depends on the first distance, and a first processing block configured to perform a processing for compensating for the non-linearity of the frequency response of the second loudspeaker along an axis linking the second loudspeaker to the first spot, and the fourth formulation means furthermore comprise second amplification means configured to amplify the fourth inverted audio content with a gain whose value depends on the second distance, and a second processing block configured to perform a processing for compensating for the non-linearity of the frequency response of the first loudspeaker along an axis linking the first loudspeaker to the second spot.

According to one embodiment, the first and fourth audio contents are stereophonic contents and the device furthermore comprises a first preprocessing module coupled between the first reception means and the first and second formulation means and a second preprocessing module coupled between the second reception means and the third and fourth formulation means, each preprocessing module comprising a stage for transforming the corresponding stereophonic audio content into a monophonic audio content, at least one first and one second branch for processing the monophonic audio content, each branch containing bandpass filtering means followed by a dynamic range compression processing block, and summation means coupled to the outputs of the processing branches.

According to one embodiment, each preprocessing module furthermore comprises a third processing branch comprising low-pass filtering means followed by a dynamic range compression processing block.

According to one embodiment, each preprocessing module furthermore comprises a fourth processing branch comprising high-pass filtering means followed by a dynamic range compression processing block.

The device can furthermore comprise means able to deliver an additional audio content to the two loudspeakers.

The device can be incorporated into a signal processing processor.

BRIEF DESCRIPTION OF THE DRAWINGS

Other advantages and characteristics of the invention will be apparent on examining the wholly non-limiting detailed description of modes of implementation and embodiments, and the appended drawings, in which.

DETAILED DESCRIPTION OF THE DRAWINGS

Figure 1:
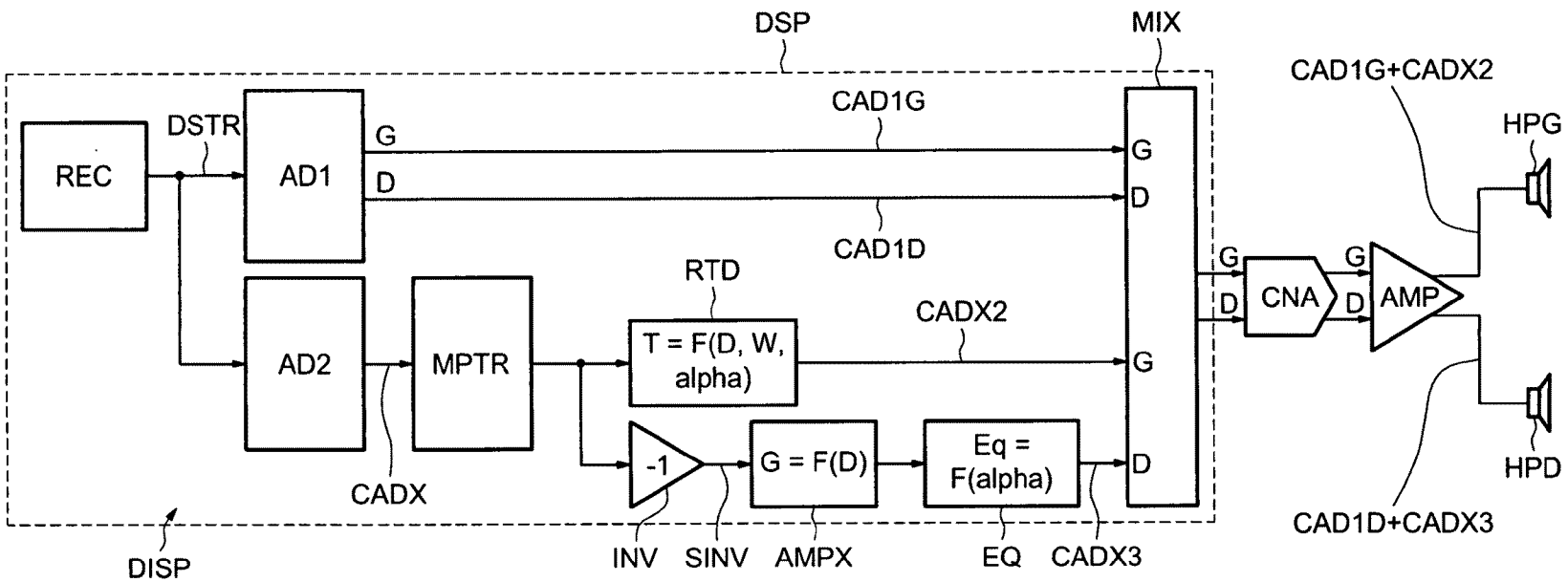
FIG. 1 illustrates a first embodiment of a device according to the invention.

In FIG. 1, the reference DSP designates a device making it possible to control the broadcasting of audio contents on the loudspeakers HPD and HPG of a television set, for example.

This device comprises at the head end a digital receiver REC receiving a television signal for example, and delivering a digital signal DSTR to a first audio decoder AD1 of conventional structure known per se, as well as to a second decoder AD2 also of conventional structure known per se.

The digital stream DSTR in fact comprises a first audio content relating for example to a television program, as well as an auxiliary audio content, for example an audiodescription of this television program.

The first audio content is decoded in the audio decoder AD1, while the auxiliary content is decoded in the audio decoder AD2 which here delivers a monophonic output.

The first audio decoder AD1 therefore delivers on its two outputs left and right the first audio content CAD1G and CAD1D to a stereophonic mixer MIX of conventional structure known per se.

The monophonic output of the decoder AD2 delivers the auxiliary audio content CADX to a preprocessing block MPTR the structure of which will be returned to in greater detail hereinafter.

The signal arising from the block MPTR undergoes a first formulation processing in first formulation means RTD so as to provide a second audio content CADX2.

More precisely, this processing is a temporal delaying of the auxiliary audio content with a delay T which depends on the geometry of the television and more particularly on the spacing W between the loudspeakers of the television set (FIG. 2) and on a distance D between a first loudspeaker, for example the left loudspeaker HPG, and a spot located in front of this first loudspeaker and where for example a first viewer AUDT1 is standing.

The second audio content CADX2 is delivered on the left channel G of the mixer MIX.

The signal arising from the preprocessing block MPTR also undergoes another formulation processing in second formulation means, so as to provide a third audio content CADX3.

This second formulation processing comprises an inversion of the signal in an inverter INV so as to provide an inverted signal SINV. Next, in an optional but preferential manner, the inverted signal undergoes an amplification with a gain G whose value depends on the distance D. This gain adjustment is performed in an amplifier AMPX.

Figure 2:
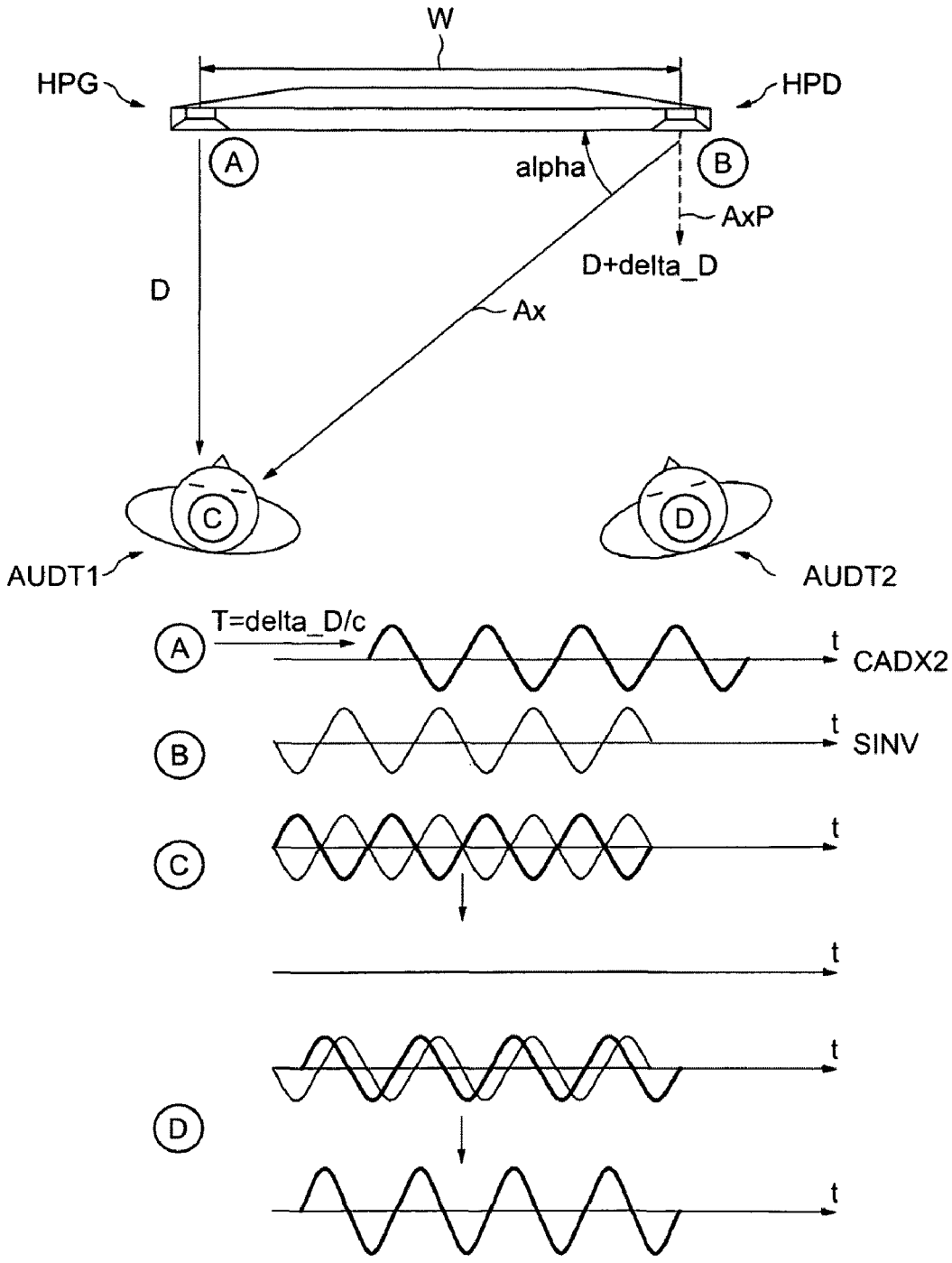
FIG. 2 illustrates in a schematic manner an exemplary implementation of the invention.

Next, the amplified signal undergoes an equalization Eq in an equalizer EQ of conventional structure known per se, so as to compensate the non-linearity of the frequency response of the second loudspeaker, here the right loudspeaker HPD, along an axis Ax (FIG. 2) linking this second loudspeaker HPD to the spot C where the viewer AUDT1 is located (FIG. 2).

The third audio content CADX3 delivered by the equalizer EU is delivered on the right pathway D of the mixer MIX.

Although advantageous, the means AMPX and EQ are not compulsory.

It is assumed, in this regard, while referring to FIG. 2, that the audio signal delivered to the spot B by the loudspeaker HPD is the inverted signal SINV. The signal delivered to the spot A by the left loudspeaker is the delayed signal CADX2. It is assumed, for the sake of simplification, that in this figure, the loudspeakers HPD and HPG do not deliver the first audio signal CAD1.

The delay T is defined by formula (1) below:

$$T=(\text{DELTA_}D)/c \tag{1}$$

In this formula, the variable DELTA_D is defined by formula (2) below:

$$\text{DELTA_}D=\sqrt{D^2+w^2}-D \tag{2}$$

Stated otherwise, the delay therefore depends on the distance D and on the spacing w between the loudspeakers.

Therefore, as illustrated in the curves at the bottom of FIG. 2, at the spot C, the viewer AUDT1 does not perceive the auxiliary audio content relating to the audiodescription of the televisual program. On the other hand, the viewer AUDT2, located at the spot D, in front of the right loudspeaker HPD, actually perceives the auxiliary content with an amplitude substantially equal to double the amplitude of this auxiliary content.

If the first audio content CAD1, which is broadcast by the two loudspeakers HPG and HPD, is now taken into account, the listener AUDT1, who is not partially-sighted, normally perceives this content CAD1 without being disturbed by the audiodescription of the televisual program, while the listener AUDT2, who is partially sighted, hears the audio content CAD1 as well as the audiodescription of the program which is currently being broadcast by the television.

Thus, it is noted that this mode of implementation and embodiment of the invention in fact makes it possible to control the directivity of the loudspeakers which, at the base, exhibit a very wide directivity angle.

So that the signal CADX3 delivered by the loudspeaker HPD has substantially the same amplitude as the signal CADX2 delivered by the loudspeaker HPG, it is preferable that the inverted signal SINV undergo a gain adjustment in the amplifier AMPX. The gain G is then a function of the distance D. It will be possible for example to use the following function with the gain G expressed in decibels (dB):

$$G(\text{dB})=-20\ \text{Log}(D/(D+\text{delta_}D))$$

This gain is there to compensate the additional attenuation due to the difference in distance between the viewer AUDT1 and each of the loudspeakers.

Moreover, it is well known that the frequency response of a loudspeaker is altered when it is measured outside its main axis AxP (FIG. 2). Hence, so as to obtain better acoustic performance, the non-linearity of the frequency response of the loudspeaker HPD along the axis Ax is compensated by an equalization processing Eq which is dependent on the angle alpha (FIG. 2), so as to be as close as possible to the frequency response of the loudspeaker along its main axis AxP.

The frequency response versus the angle alpha (off the axis) of a loudspeaker is characterized by an attenuation of the high frequencies. This attenuation can vary according to the nature of the loudspeakers used. This attenuation can be compensated by virtue of a filter of High Pass Shelving type, whose transfer function H (s) can be the following:

$$H(s)=G\frac{s+\omega_o(1-\alpha)}{s+\omega_o(1+\alpha)}$$

or else $$H(s)=\frac{\frac{s}{\omega_o(1+\alpha)}+1}{\frac{s}{\omega_o(1-\alpha)}+1}$$

with $$\alpha=\frac{G-1}{G+1}$$

In these formulae $\omega_o$ is the cutoff frequency and G the gain. G is dependent on the loudspeaker used and on the angle alpha.

Now returning to FIG. 1, the various signals CAD1G, CAD1D, CADX2 and CADX3 are mixed in the stereophonic mixer MIX. Next, the two pathways left and right are converted in a digital to analog conversion stage DAC before being amplified in an amplifier AMP and then delivered to the loudspeakers HPG and HPD.

Figure 3:
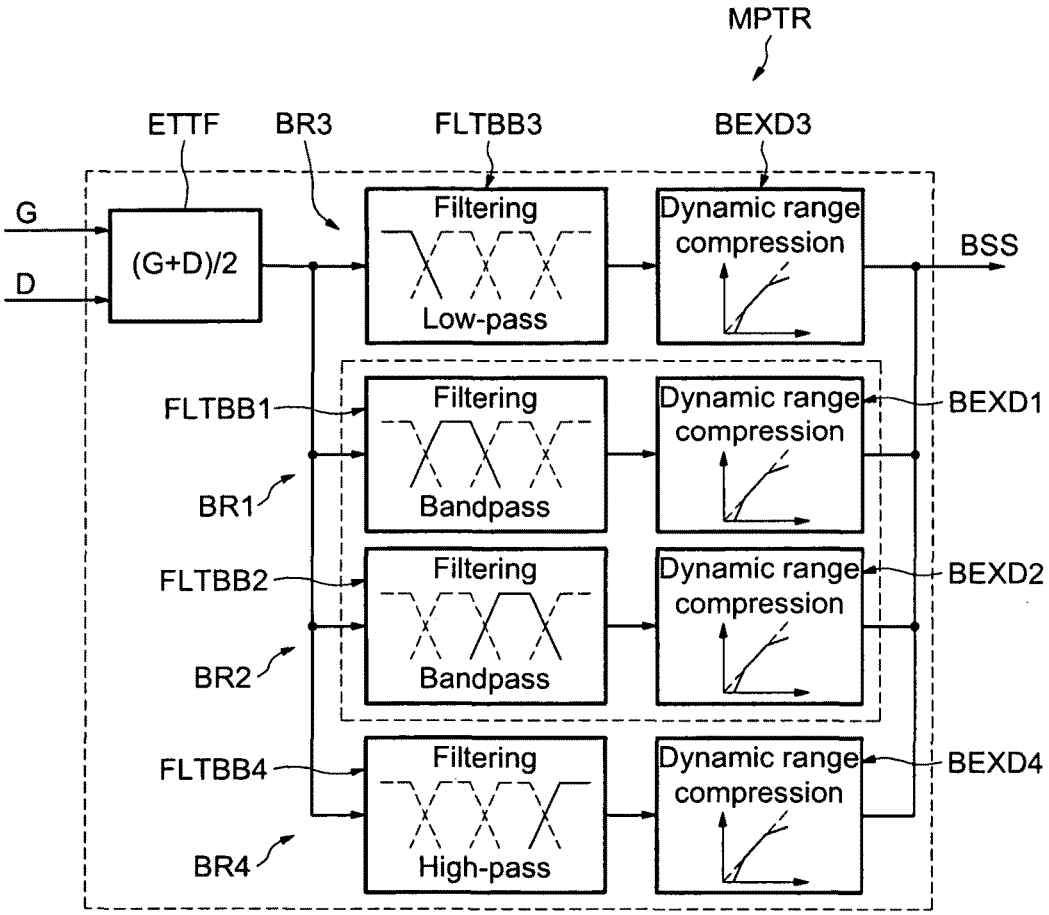
FIG. 3 illustrates in a schematic manner an exemplary preprocessing module of a device of FIG. 1.

Reference is now made more particularly to FIG. 3 to illustrate an exemplary embodiment of the preprocessing block MPTR, which makes it possible in particular to improve the quality of the voice.

When the signal CADX delivered by the decoder AD2 is a stereophonic signal, provision is made first of all for a transformation of the stereophonic auxiliary audio content into a monophonic auxiliary content in a conventional stereophonic/monophonic transformation stage ETTF.

When the auxiliary audio content CADX is directly a monophonic content, this stage ETTF is of course not present in the block MPTR.

The block MPTR moreover comprises several processing branches, here four processing branches BR1, BR2, BR3 and BR4.

The processing branches BR1 and BR2 make it possible to improve the auditory quality of the dialogues.

In a general manner, it is possible to identify four characteristic frequency zones in the signal of the human voice (see table below).

| | Low cutoff | Fundamental | Sensible freq | Harmonics |
|---|---|---|---|---|
| Male Voice | 100 Hz | 200 Hz | 2 kHz (+) | 4 to 5 kHz |
| Female Voice | 120 Hz | 300 to 400 Hz | 2.5 kHz | 5 to 6 kHz |
| Spoken Voice | 120 Hz | 200 Hz | 2 to 3 kHz | 4 kHz |

The characteristics of the four processing branches are adapted as a function of these frequencies. Examples of adaptation are indicated hereinafter.

The first processing branch BR1 comprises first of all a bandpass filtering performed in filtering means FLTBB1. Here the band concerned is the 150 Hz~500 Hz band.

The second processing branch BR2 also comprises a bandpass filtering performed in filtering means FLTBB2. But this time, the band concerned is the band immediately above, namely the 500 Hz~3.5 kHz band.

Each processing branch moreover comprises following the filtering means a dynamic range compression block BEXDi.

A dynamic range compression block has a conventional structure known per se.

As its name indicates, a dynamic range compression block reduces the dynamic range of the audio signal.

A compression is generally defined by a ratio a:b which signifies that the input level of the signal must increase by "a" decibels to create an increase of "b" decibels at the output, this being so when the level of the input signal exceeds a certain threshold.

Moreover, the response time of the compressor when the input level exceeds this threshold is generally called the "attack time" A. When the input level of the signal drops back below the threshold, the compressor will then take a certain time to once more increase the gain. This time is called the "reamplification time" D. This time is generally greater than the attack time.

By way of indication, the dynamic range compression blocks BEXD1 and BEXD2 exhibit ratios that may lie between 1:2 and 1:5 with values A of the order of 10 milliseconds and values D lying between 100 and 400 milliseconds.

These dynamic range compression blocks will thus allow equalization of the voice content of the audio signals.

In addition to these two processing branches BR1 and BR2, the preprocessing module MPTR advantageously comprises a third processing branch BR3 also comprising filtering means and a dynamic range compression block.

The filtering means FLTBB3 of the processing branch BR3 are now low-pass filtering means having a cutoff frequency of the order of 150 Hz and allow homogenization of the whole of the signal so as to reduce in particular the acoustic characteristics of the sound environment.

The ratio of the dynamic range compression block BEXD3 can now vary between 1:2 and 1:10 while the value A can be taken equal to 50 milliseconds and the value D can lie between 200 and 500 milliseconds.

The preprocessing module MPTR also preferably comprises a fourth processing branch BR4, comprising high-pass filtering means FLTBB4 having a cutoff frequency of the order of 3.5 kHz, also followed by a dynamic range compression block BEXD4 whose ratio can vary between 1:2 and 1:4 with a constant A equal to 3 milliseconds and a constant D also lying between 50 and 300 milliseconds. The fourth processing branch will make it possible in particular to correct the brightness and the clarity of the sound.

The outputs of the four processing branches are summed and the resulting signal is delivered to the output BSS of the preprocessing module.

The various filtering means can preferably be embodied with finite impulse response filters exhibiting linear phases, or else with infinite impulse response filters, such as biquadratic filters.

The whole of the device DISP can be incorporated into a signal processing processor DSP that can itself be incorporated into a decoder box (set top box) or else directly into the television.

Figure 4:
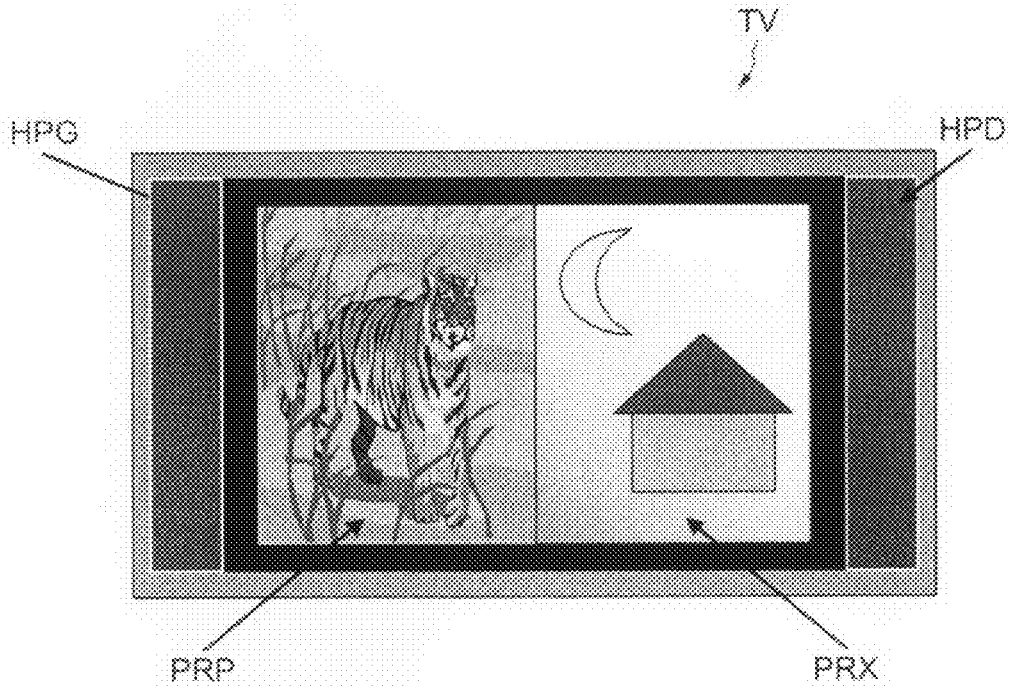
FIG. 4 schematically illustrates another application of the invention.

Reference is now made particularly to FIG. 4 et seq to illustrate other possible applications.

In FIG. 4, it is assumed that a television TV is simultaneously broadcasting two programs on the screen, namely on the left part of the screen, a main program PRP and on the right part of the screen an auxiliary program PRX.

Figure 7:
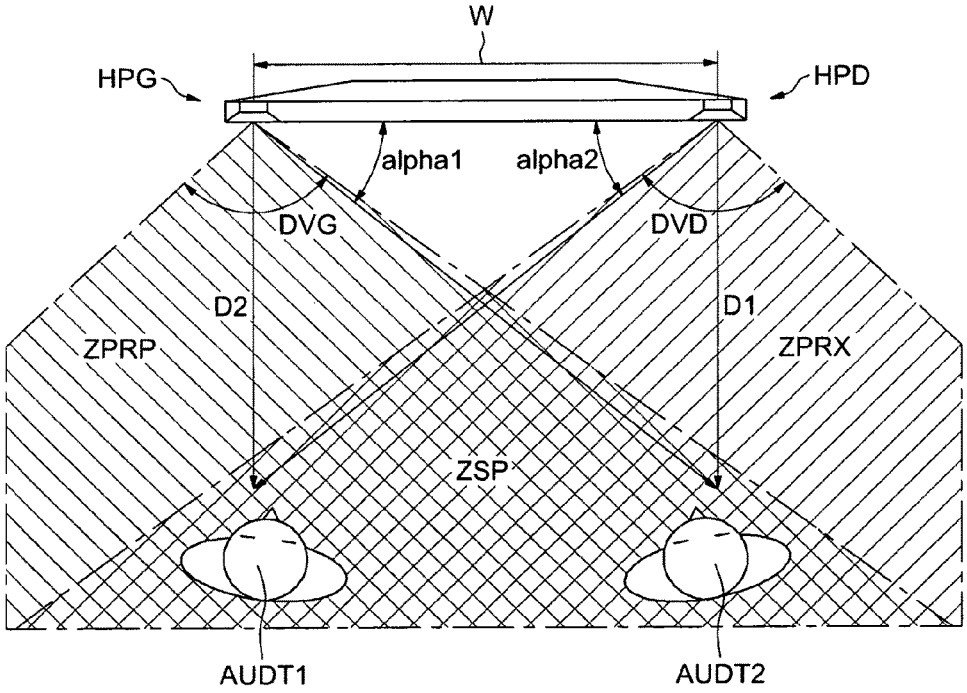

As illustrated in FIG. 7, each loudspeaker exhibits a wide directivity DVG, DVD. Stated otherwise, these angles are such that a listener AUDT1 located in front of one loudspeaker can also perceive the sound emitted by the other loudspeaker.

Now referring more particularly to FIG. 5, it is seen that the device DISP comprises in a manner analogous to what was described with reference to FIG. 1, a digital receiver REC delivering the digital stream DSTR comprising a first audio content relating to the main program PRP and another audio content relating to the auxiliary program PRX. Each of the audio contents is decoded in a respective audio decoder AD1, AD2.

The corresponding decoded stereophonic audio contents are preprocessed in respective preprocessing modules MPTR1 and MPTR2 with structures analogous to that of the preprocessing module MPTR described with reference to FIG. 3.

The preprocessing module MPTR1 thus delivers the first audio content CAD1, while the preprocessing module MPTR2 delivers an audio content CAD4 that here is called the fourth audio content.

Figure 6:
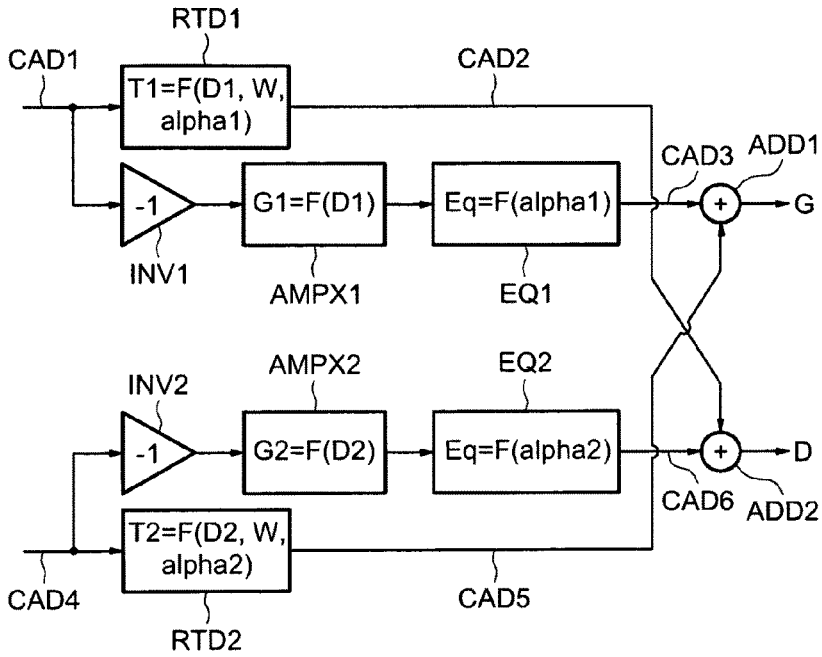

These two audio contents will undergo a cross-suppression processing in a stage CCN illustrated more specifically in FIG. 6.

In fact, the formulation means which have been described in detail with reference to FIG. 1 are found again duplicated in this stage CCN.

More precisely, the stage CCN comprises first formulation means, comprising first delay means RTD1, configured to temporally delay the first audio content CAD1 with a delay T1 dependent on the spacing W between the loudspeakers, and on a first distance D1 between a first loudspeaker (for example the right loudspeaker HPD), and a first spot located in front of this first loudspeaker and where the viewer AUDT2 is standing.

The delay means RTD1 deliver the second audio content CAD2.

The stage CCN moreover comprises second formulation means comprising first inversion means INV1 for performing an inversion of the first audio content CAD1. These first inversion means are followed by first amplification means AMPX1 and by first equalization means EQ1.

The first equalization means deliver the third audio signal CAD3.

In a manner analogous to what was described with reference to FIG. 1, the adjustment of the gain G1 depends on the first distance D1 while the equalization Eq depends on the angle alpha1.

The stage CCN moreover comprises third formulation means comprising second delay means RTD2 configured to temporally delay the fourth audio content CAD4 with a delay T2 dependent on the spacing W between the loudspeakers and on a second distance D2 between the second loudspeaker (here the left loudspeaker HPG) and a second spot located in front of this second loudspeaker and where the viewer AUDT1 is standing.

The second delay means RTD2 deliver a fifth audio content CAD5.

Moreover, the stage CCN also comprises fourth formulation means comprising second inversion means INV2 configured to perform an inversion of the fourth audio content CAD4. These second inversion means INV2 are followed by second amplification means AMPX2 and by second equalization means EQ2 which deliver a sixth audio content CAD6. The gain adjustment performed in the second amplification means AMPX2 depends on the second distance D2 while the equalization processing Eq depends on the angle alpha2.

Figure 5:
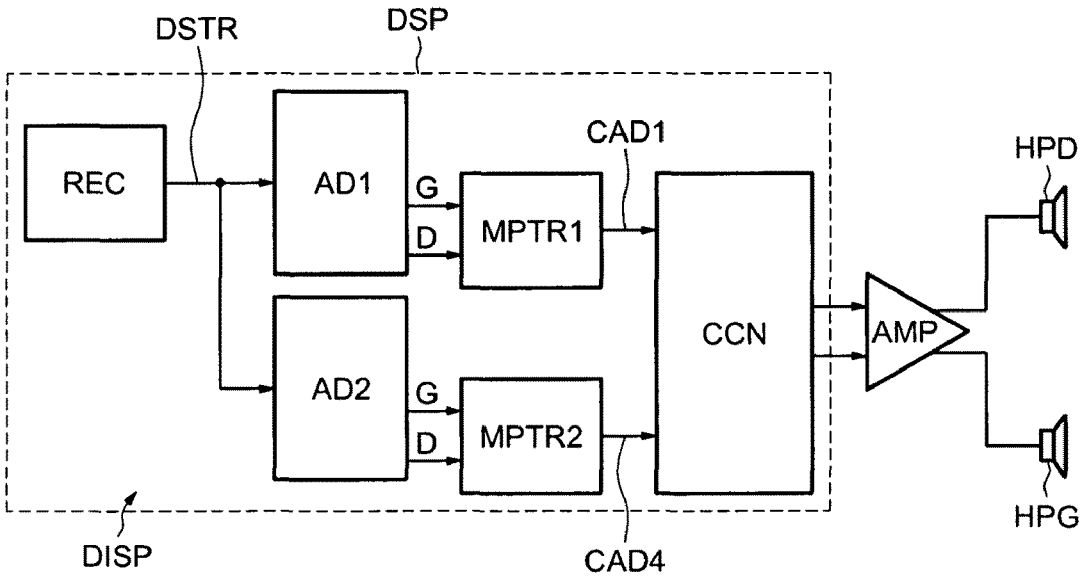
FIGS. 5 to 9 schematically illustrate other embodiments and modes of implementation of the invention.

The third audio content CAD3 and the fifth audio content CAD5 are summed in a first adder ADD1 with a view to being delivered on the left pathway G of the mixer MIX (not represented for the sake of simplification in FIG. 5).

Likewise, the second audio content CAD2 and the sixth audio content CAD6 are summed in a second adder ADD2 before being delivered on the right pathway D of the mixer MIX.

Thus, as seen in FIG. 7, the sound broadcasting space of the loudspeakers comprises three zones, namely a zone ZPRP arising from the left loudspeaker HPG and in which the audio contents relating to the main program and to the auxiliary program are present, a zone ZPRX arising from the right loudspeaker HPD and in which the audio contents of the main program and of the auxiliary program are also present, as well as a zone ZSP in which the viewers AUDT1 and AUDT2 are located.

In the left part of this zone ZSP, that is to say just where the viewer AUDT1 is located, the audio content relating to the auxiliary program PRX is not audible by the viewer AUDT1, and consequently the latter perceives only the audio content relating to the main program.

On the other hand, in the right part of the zone ZSP, the viewer AUDT2 does not perceive the audio content relating to the main program and perceives only the audio content relating to the auxiliary program PRX.

Figure 8:
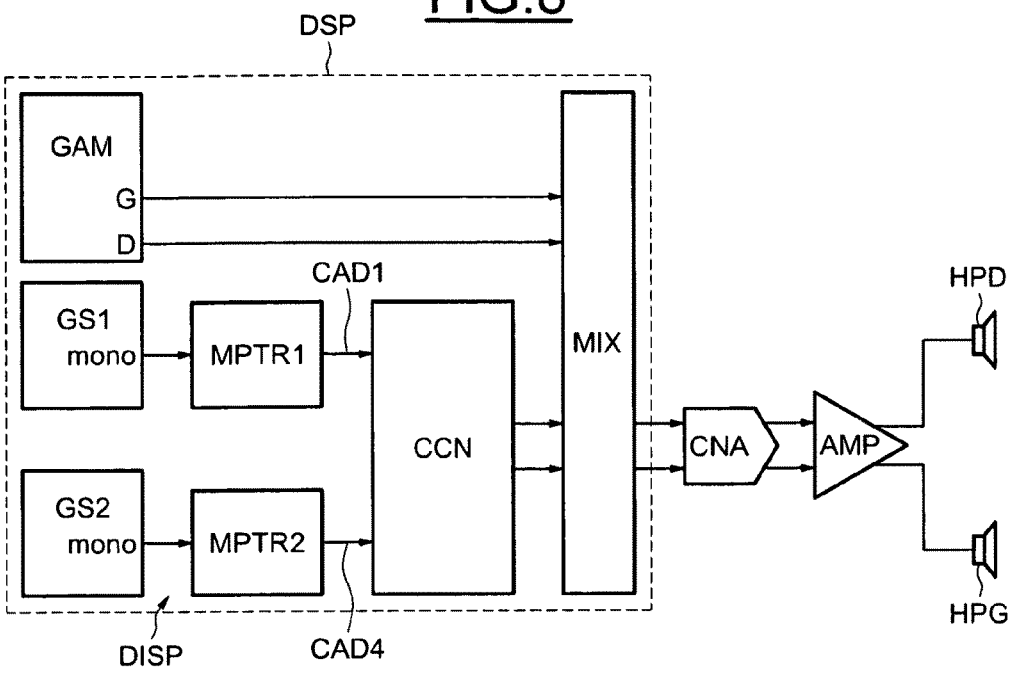
Figure 9:
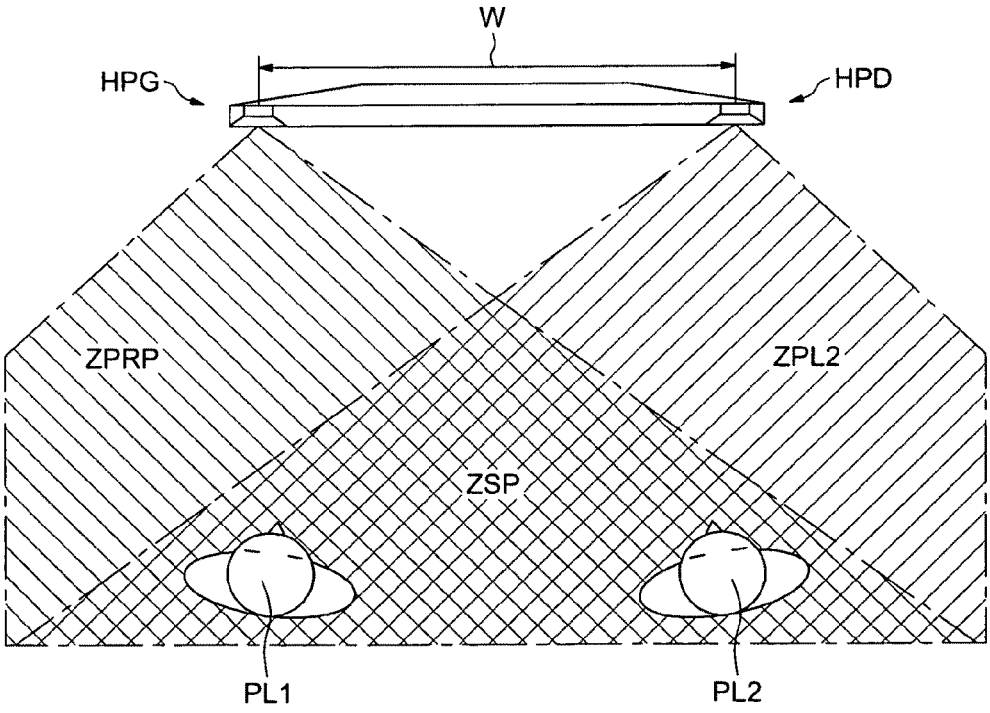

FIGS. 8 and 9 schematically illustrate an application of the invention to a video game.

In this case, the device DISP is preferably incorporated into a game console. The device DISP comprises generating means GS1 able to deliver an audio content intended for the player PL1 (FIG. 9).

Generating means GS2 deliver an audio content intended for the player PL2.

In a manner analogous to what was described with reference to FIG. 5, the device DISP comprises a preprocessing block MPTR1 and a preprocessing block MPTR2 delivering respectively the first and fourth audio contents CAD1 and CAD4 to a stage CCN analogous to that illustrated in FIG. 6.

Further to these means, the device DISP of FIG. 8 comprises means GAM able to generate an additional audio content, for example, an atmospheric sound background. The whole of the audio contents are mixed in a stereophonic manner in a mixer MIX and then converted in a digital/analog converter DAC before being amplified in an amplifier AMP and then broadcast on the loudspeakers HPG and HPD.

Here again, as illustrated in FIG. 9, the sound broadcasting space of the loudspeakers HPG and HPD comprises three zones, namely the zones ZPL1, ZPL2 and ZSP.

In the zones ZPL1 and ZPL2 the whole of the audio contents are audible.

On the other hand, as in FIG. 7, the zone ZSP is an acoustic suppression zone for certain audio contents.

More precisely, in the left part of the zone ZSP, that is to say just where the player PL1 is located, the latter will perceive only the atmospheric background and the sound which is intended for him. Likewise, in the right part of the zone ZSP, that is to say just where the player PL2 is located, the latter will also perceive the atmospheric sound and the sound which is intended for him.

Neither of the players will be disturbed by the audio content intended for the other player.

Others applications of the invention are possible in which two different simultaneously broadcasted images are not respectively broadcasted in two different parts of the screen (for example in the left part and in the right part of the screen). This is the case for example for 3D TV apparatuses where a first person having 3D glasses is watching a first image while a second person, having also 3D glasses, is watching a second image. However the two persons are not mutually disturbed on a sound point of view.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A method of controlling the broadcasting of audio contents by two loudspeakers, comprising:

delivery of a first audio content to the two loudspeakers, reception of an auxiliary audio content, formulation of a second audio content comprising a temporal delaying of the auxiliary audio content with a delay dependent on a spacing between the two loudspeakers and on a distance between a first one of the loudspeakers and a spot located in front of this first loudspeaker, delivery of the second audio content to this first loudspeaker, formulation of a third audio content comprising an inversion of the auxiliary audio content, and delivery of the third audio content to a second one of the loudspeakers.

2. The method according to claim 1, wherein formulation of the third audio content comprises:

amplification of the inverted auxiliary audio content with a gain whose value depends on the distance, and processing for compensating for a non-linearity of the frequency response of the second loudspeaker along an axis linking the second loudspeaker to the spot.

3. The method according to claim 1, wherein the auxiliary audio content is a monophonic content, the method further comprising preprocessing of the auxiliary audio content before the formulation of the second and third audio contents, this preprocessing comprising at least one first and one second elementary processing of the monophonic auxiliary audio content, each elementary processing containing bandpass filtering followed by a dynamic range compression processing, and a summation of the signals respectively arising from the elementary processing.

4. The method according to claim 1, wherein the auxiliary audio content is a stereophonic content, the method further comprising preprocessing of the auxiliary audio content before the formulation of the second and third audio contents, this preprocessing comprising a transformation of the stereophonic auxiliary audio content into a monophonic auxiliary audio content, at least one first and one second elementary processing of the monophonic auxiliary audio content, each elementary processing containing bandpass filtering followed by a dynamic range compression processing, and a summation of the signals respectively arising from the elementary processing.

5. The method according to claim 4, wherein the preprocessing further comprises a third elementary processing comprising a low-pass filtering followed by a dynamic range compression processing.

6. The method according to claim 5, wherein the preprocessing further comprises a fourth elementary processing comprising a high-pass filtering followed by a dynamic range compression processing.

7. The method according to claim 1, wherein the auxiliary audio content is a description audio of a video content.

8. A device for controlling the broadcasting of audio contents by two loudspeakers, comprising:

a first circuit adapted to deliver a first audio content (CAD1) to the two loudspeakers, a reception circuit adapted to receive an auxiliary audio content, a first formulation circuit adapted to formulate a second audio content comprising: a delay circuit adapted to temporally delay the auxiliary audio content with a delay dependent on a spacing between the two loudspeakers and on a distance between a first one of loudspeakers and a spot located in front of this first loudspeaker, a second circuit adapted to deliver the second audio content to this first loudspeaker, a second formulation circuit adapted to formulate a third audio content comprising: an inversion circuit adapted to perform an inversion of the auxiliary audio content, and a third delivery circuit adapted to deliver the third audio content to the a second one of the loudspeakers.

9. The device according to claim 8, wherein the second formulation circuit further comprises:

an amplifier adapted to amplify the inverted auxiliary audio content with a gain whose value depends on the distance, and a processor adapted to perform a processing for compensating for a non-linearity of a frequency response of the second loudspeaker along an axis linking the second loudspeaker to the spot.

10. The device according to claim 8, wherein the auxiliary audio content is a monophonic content and the device further comprises: a preprocessing module coupled between the reception circuit and the first and second formulation circuits, this preprocessing module comprising at least one first and one second branch adapted to process the monophonic auxiliary audio content, each processing branch containing a bandpass filter followed by a dynamic range compression processing block, and a summation circuit coupled to the outputs of the processing branches.

11. The device according to claim 8, wherein the auxiliary audio content is a stereophonic content and the device further comprises: a preprocessing module coupled between the reception circuit and the first and second formulation circuits, this preprocessing module comprising a stage adapted to transform the stereophonic auxiliary audio content into a monophonic auxiliary audio content, at least one first and one second branch adapted to process the monophonic auxiliary audio content, each processing branch containing a bandpass filter followed by a dynamic range compression processing block, and a summation circuit coupled to the outputs of the processing branches.

12. The device according to claim 11, wherein the preprocessing module further comprises a third processing branch comprising a low-pass filter followed by a dynamic range compression processing block.

13. The device according to claim 12, wherein the preprocessing module further comprises a fourth processing branch comprising a high-pass filter followed by a dynamic range compression processing block.

14. The device according to claim 8, wherein the reception circuit is adapted to receive a description audio of a video content in the guise of auxiliary audio content.

15. The device according to claim 8 as incorporated into a signal processing processor (DSP).

16. A method, comprising:

decoding first audio content to generate decoded first side and second side first audio content;

decoding second audio content to generate decoded first side and second side second audio content;

combining the decoded first side and second side second audio content to generate combined second audio content;

temporally delaying the combined second audio content with a delay dependent on a spacing between first side and second side speakers and on a distance between the first side speaker and a spot located in front of the first side speaker to generate a first side delayed second audio content;

inverting the combined second audio content to generate a second side inverted second audio content; and stereophonically mixing the first side first audio content, second side first audio content, first side delayed second audio content and second side inverted second audio content to generate a first side speaker signal and a second side speaker signal.

17. The method of claim 16, further comprising: converting the first side speaker signal and second side speaker signal to analog signals.

18. The method of claim 17, further comprising: amplifying the analog signals for application first and second side speaker devices.

19. The method of claim 16, wherein inverting the combined second audio content further comprises: amplifying the second side inverted second audio content and equalizing the amplified second side inverted second audio content.

20. The method of claim 16, wherein the first audio content comprises television program audio content and the second audio content comprises an audiodescription of the television program.

21. The method of claim 16, wherein combining the decoded first side and second side second audio content comprises: adding the decoded first side and second side second audio content and bandpass filtering of the added content.

22. The method of claim 21, wherein bandpass filtering comprising passing the added content through multiple bandpass filters having different passbands and combining output from the multiple bandpass filters to generate the combined second audio content.

23. The method of claim 22, wherein the different passbands are selected from passbands tuned to at least male speech frequencies and female speech frequencies.

24. Apparatus, comprising:

a first decoder configured to decode first audio content into decoded first side and second side first audio content;

a second decoder configured to decode second audio content into decoded first side and second side second audio content;

a combiner configured to combine the decoded first side and second side second audio content into combined second audio content;

a delay circuit configured to temporally delay the combined second audio content with a delay dependent on a spacing between first side and second side speakers and on a distance between the first side speaker and a spot located in front of the first side speaker to generate a first side delayed second audio content;

an inverter circuit configured to invert the combined second audio content to generate a second side inverted second audio content; and a stereophonic mixer configured to mix the first side first audio content, second side first audio content, first side delayed second audio content and second side inverted second audio content to generate a first side speaker signal and a second side speaker signal.

25. The apparatus of claim 24, further comprising: a digital to analog converter coupled to outputs of the stereophonic mixer.

26. The apparatus of claim 25, further comprising: an amplifier coupled to outputs of the digital to analog converter to produce signal for application to first and second side speaker devices.

27. The apparatus of claim 24, further comprising: an amplifier configured to amplify the second side inverted second audio content, and an equalizer configured to process the amplified second side inverted second audio content.

28. The apparatus of claim 24, wherein the first audio content comprises television program audio content and the second audio content comprises an audiodescription of the television program.

29. The apparatus of claim 24, wherein the combiner comprises: an adder configured to add the decoded first side and second side second audio content, and a bandpass filtering circuit configured to filter the added content.

30. The apparatus of claim 29, wherein the bandpass filtering circuit comprises a plurality of bandpass filters having different passbands, and further comprising a combiner configured to combine outputs from the plurality of bandpass filters to generate the combined second audio content.

31. The apparatus of claim 30, wherein the different passbands are selected from passbands tuned to at least male speech frequencies and female speech frequencies.

* * * * *